US012808584B1

(12) United States Patent
Bahman et al.

(10) Patent No.: US 12,808,584 B1
(45) Date of Patent: Nov. 24, 2026

(54) ADSORPTION REFRIGERATION SYSTEMS AND METHODS WITH ATMOSPHERIC WATER HARVESTING AND SOLAR HEATING

(71) Applicant: KUWAIT UNIVERSITY, Safat (KW)

(72) Inventors: Ammar M. Bahman, Safat (KW); Najam Ul Qadir, Islamabad (PK)

(73) Assignee: KUWAIT UNIVERSITY, Safat (KW)

( * ) Notice: Subject to any disclaimer, the term of this patent is extended or adjusted under 35 U.S.C. 154(b) by 0 days.

(21) Appl. No.: 19/414,722

(22) Filed: Dec. 10, 2025

(51) Int. Cl.
*F25B 17/08* (2006.01)

(52) U.S. Cl.
CPC ..... *F25B 17/08* (2013.01)

(58) Field of Classification Search
CPC ..... F25B 17/08; F25B 17/00
See application file for complete search history.

(56) References Cited

U.S. PATENT DOCUMENTS

| | | | |
|---|---|---|---|
| 4,377,398 A | 3/1983 | Bennett | |
| 5,137,548 A | 8/1992 | Grenier | |
| 7,497,089 B2 | 3/2009 | Kakiuchi et al. | |
| 10,309,694 B2 | 6/2019 | Hirota et al. | |
| 11,577,193 B2 | 2/2023 | Fong et al. | |
| 11,697,925 B2 * | 7/2023 | Yaghi | B01D 5/0003 95/115 |

FOREIGN PATENT DOCUMENTS

| | | | | |
|---|---|---|---|---|
| CN | 101782291 A | * | 7/2010 | F25B 27/007 |
| CN | 106524571 A | | 3/2017 | |

* cited by examiner

*Primary Examiner* — Ana M Vazquez
(74) *Attorney, Agent, or Firm* — Nath, Goldberg & Meyer; Joshua B. Goldberg

(57) ABSTRACT

Adsorption refrigeration systems and methods integrate atmospheric moisture harvesting with solar-heated air regeneration of an adsorbent bed. Ambient air is introduced into an atmospheric moisture harvester to produce dried air and liquid moisture. Dried air is directed to a solar air-heating unit, which heats the airflow using a solar receiver tube, concentrated solar radiation, and mechanical compression, to form heated dried air suitable for desorption. The heated dried air is supplied to at least one adsorbent bed containing an adsorbent material to regenerate the bed during a desorption phase. Liquid moisture separated in the moisture harvester is delivered to an evaporator and vaporized to form refrigerant vapor, which is supplied to the adsorbent bed during an adsorption phase. In certain embodiments, two adsorbent beds alternate between adsorption and desorption phases. Air exiting a desorbing bed is recirculated for moisture removal. Methods of operating the disclosed systems are also provided.

20 Claims, 5 Drawing Sheets

ADSORPTION REFRIGERATION SYSTEMS AND METHODS WITH ATMOSPHERIC WATER HARVESTING AND SOLAR HEATING

BACKGROUND

Field

The disclosure of the present patent application relates to adsorption refrigeration technologies, and particularly to adsorption refrigeration systems that employ direct air-assisted thermal regeneration of an adsorbent bed. The disclosed systems integrate atmospheric water harvesting to supply refrigerant derived from moisture extracted from ambient air. The systems further include using concentrated solar energy to heat air which is directed into contact with an adsorbent material.

Description of Related Art

Adsorption-based refrigeration systems are an established alternative to conventional vapor-compression cooling technologies, particularly in applications where thermal energy sources such as solar heat are available. These systems typically rely on solid adsorbent materials that cyclically adsorb and desorb a refrigerant vapor to produce cooling.

Conventional adsorption refrigeration systems generally depend on hot-water circulation to regenerate the adsorbent during the desorption phase. In such systems, heated water is routed through copper tubing embedded within or adjacent to the packed adsorbent bed. Heat must then be transferred from the water through multiple thermal interfaces before reaching the adsorbed refrigerant. This heat path involves five sequential thermal resistances, from hot water to the tubing, through the tubing walls, and then through adjacent adsorbent particles to the adsorbed refrigerant itself. These resistances significantly slow desorption, resulting in slowed regeneration, long cycle times, and reduced cooling capacity.

A further limitation of adsorption refrigeration systems arises from the inherently low thermal conductivity of commonly used adsorbents such as silica gel, zeolites, and many metal-organic frameworks. These materials impede heat penetration within the packed bed, which further lengthens desorption time and compounds the performance limitations worsened by the hot-water heating approach.

Together, these deficiencies lead to low coefficients of performance (COP), reduced throughput, and an inability to meet the cooling demands of many commercial and industrial applications. Despite advances in adsorbent materials and system configurations, the reliance on indirect water-based heating and the thermal barriers inherent in adsorbent beds remain fundamental bottlenecks in the performance of adsorption refrigeration technology.

Attempts to improve desorption efficiency have generally focused on optimizing water-heating sources, enhancing heat exchanger designs, or modifying bed geometries. However, no prior systems have replaced water-assisted heating with direct exposure of the packed adsorbent to a high-temperature, low-moisture air stream. Nor have prior systems been configured to harvest atmospheric moisture to supply refrigerant for the refrigeration cycle.

Thus, adsorption refrigeration systems and methods using atmospheric water harvesting and solar heating, solving the aforementioned problems, are desired.

SUMMARY

The present disclosure addresses limitations in conventional adsorption refrigeration systems, particularly those relying on indirect water-based heating for adsorbent regeneration and lacking practical integration with atmospheric moisture harvesting. To overcome these constraints, the disclosed systems utilize a coupled configuration in which ambient air serves as both the source of refrigerant and the medium for direct thermal regeneration of an adsorbent bed using solar-heated air.

In various embodiments, an adsorption refrigeration system includes an atmospheric moisture harvester configured to remove water vapor from ambient air and produce a dried-air stream and a corresponding liquid-moisture stream. The atmospheric moisture harvester may incorporate a moisture-selective membrane, a vacuum pump to establish reduced-pressure airflow, a condenser to liquefy separated moisture, and a storage tank for collecting the resulting refrigerant supply. Residual-moisture air may be recirculated for additional drying where desired.

The dried-air stream produced by the moisture harvester is directed to a solar air-heating unit configured to heat the air to form heated dried air suitable for desorption of an adsorbate from an adsorbent material. In certain embodiments, the solar air-heating unit includes a solar receiver tube exposed to concentrated solar radiation, one or more collectors such as parabolic trough or Fresnel collectors, and optional compression and turbine-driven expansion stages. The solar air-heating unit may raise the dried air to temperatures of at least 300° C.

The heated dried air from the solar air-heating unit is supplied directly into contact with an adsorbent material contained within at least one adsorbent bed to regenerate an adsorbent during a desorption phase. In some embodiments, the adsorption refrigeration unit includes two adsorbent beds operated in alternating adsorption and desorption phases. Air exiting a desorbing bed may be returned to the atmospheric moisture harvester for removal of desorbed moisture.

A portion of the liquid moisture collected by the atmospheric moisture harvester is delivered to an evaporator to serve as refrigerant. Within the evaporator, the refrigerant is vaporized and supplied to an adsorption bed during its adsorption phase. Valves may be used throughout the system to regulate flows of dried air, heated air, refrigerant vapor, and cooling water.

Methods of operating the system are also provided. In certain embodiments, the methods include introducing ambient air into the atmospheric moisture harvester, separating moisture to produce dried air and liquid moisture, heating the dried air using solar energy, regenerating an adsorbent bed using the heated dried air, supplying at least a portion of the liquid moisture to the evaporator, and delivering vaporized refrigerant to an adsorption bed during an adsorption phase. Additional embodiments include directing dried air through a solar-heated receiver tube and passing ambient air across a moisture-selective membrane.

Systems integrating these features enable a solar-powered adsorption refrigeration cycle driven by atmospheric moisture harvesting and direct air-assisted adsorbent regeneration. The disclosed arrangements improve desorption efficiency, reduce cycle times, and support continuous cooling operation powered substantially by ambient air and solar radiation.

These and other features of the present subject matter will become readily apparent upon further review of the following specification.

BRIEF DESCRIPTION OF DRAWINGS

Similar reference characters denote corresponding features consistently throughout the attached drawings.

DETAILED DESCRIPTION

Figure 1:
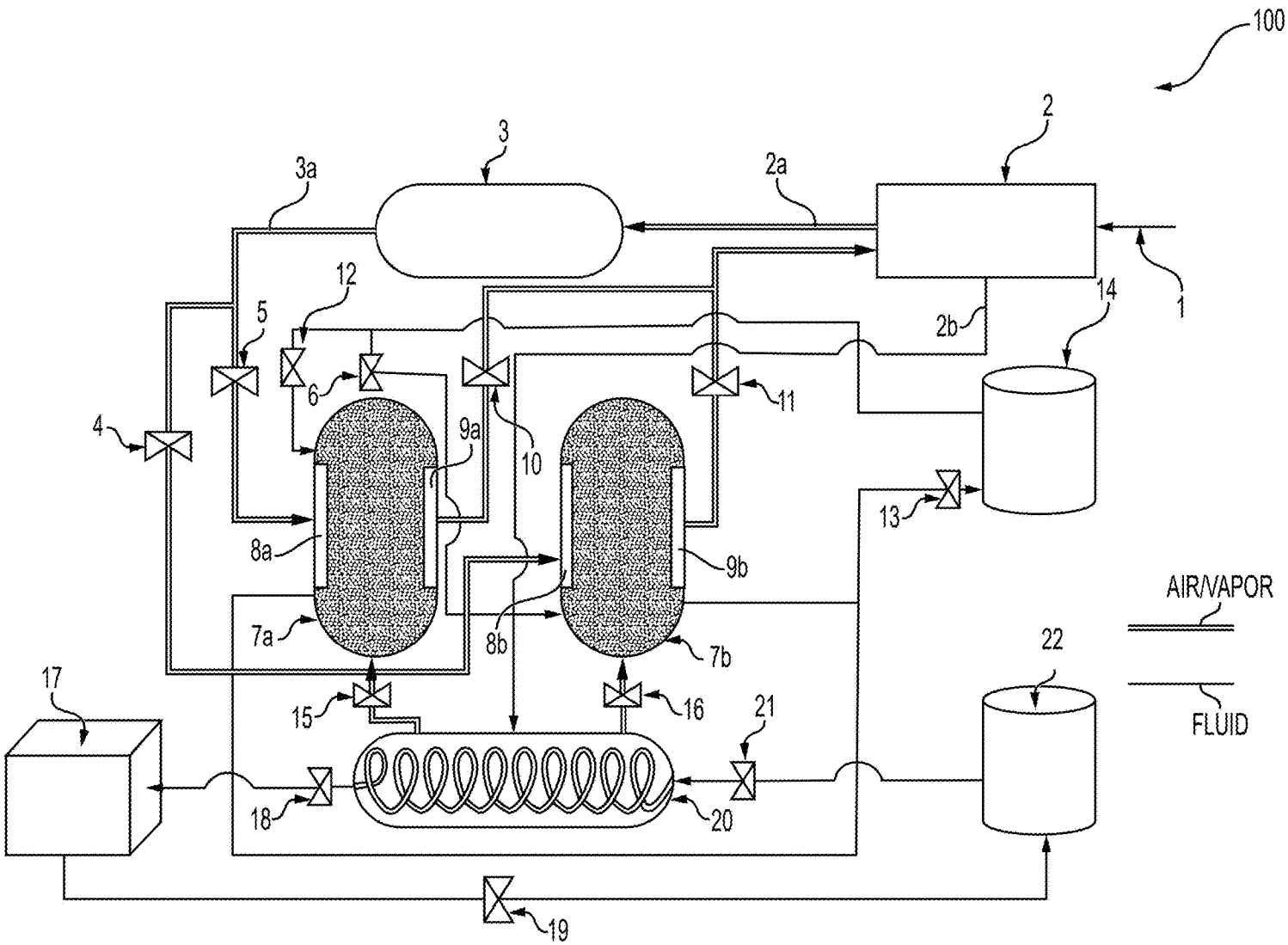
FIG. 1 is a schematic diagram of an integrated adsorption refrigeration system including an atmospheric water-harvester, a solar air-heater and dual adsorption beds.

FIG. 1 illustrates an embodiment of an integrated solar-driven adsorption refrigeration system 100 incorporating an atmospheric moisture harvester 2 and a solar air-heater 3. Ambient air enters the system through an intake duct 1 and is directed into the atmospheric moisture harvester 2, where moisture is removed to yield a dried-air stream 2*a* and a condensed-liquid stream 2*b* that is later used as refrigerant. The dried air 2*a* passes to a solar air heater 3, where it is heated, typically to several hundred degrees Celsius, forming heated dried air 3*a*. The heated dried air 3*a* is routed through one-way valves 4 and 5 to either of two adsorption beds 7*a* and 7*b*. Each adsorption bed (7*a*, 7*b*) contains an adsorbent material and is equipped with a corresponding air distributor (8*a*, 8*b*) at its inlet and an air collector (9*a*, 9*b*) at its outlet to ensure homogeneous distribution and collection of the heated air. Heated dry air entering a bed undergoing desorption promotes regeneration of the adsorbent, and the resulting vapor-enriched air exits through collectors (9*a*, 9*b*) and is returned to the atmospheric moisture harvester (2) through one-way valves (10, 11) for moisture removal.

The adsorbent materials suitable for use in the adsorption beds (7*a*, 7*b*) include those capable of withstanding elevated temperatures associated with the heated dried air 3*a* from the solar air-heater 3. In particular, high-temperature-tolerant classes of adsorbents such as zeolites, mixed metal oxides, and selected metal-organic frameworks (MOFs), including MIL-101(Cr), UiO-type structures, and zeolitic imidazolate frameworks (ZIFs), may be employed. Among these, MIL-101(Cr) provides especially favorable performance due to its combination of high water-vapor uptake capacity, hydrostability, and hydrothermal cyclic stability. As used herein, 'regeneration of the adsorbent' refers to the desorption process in which heated dry air removes moisture previously adsorbed within the porous structure of the adsorbent material, thereby restoring adsorption capacity within the adsorbent beds (7*a*, 7*b*) for the next cycle. In particular, heated the dry air does not physically dislodge the adsorbate. Instead, heated dry air heats the adsorbent and raises the equilibrium vapor pressure of the adsorbed water. The resulting low-humidity purge air exits the bed and provides a vapor-pressure gradient that drives the water to evaporate from the pores of the adsorbent material. The air exiting from the bed then convectively carries away the desorbed vapor, thereby regenerating the adsorbent.

Although the heated dry air 3*a* delivered from the solar air heater 3 may reach temperatures of at least 300° C., and more particularly between 400-500° C., the air distributor within each adsorption bed reduces the inlet pressure and spreads the flow uniformly across the bed, producing a temperature decline sufficient to avoid thermal degradation of MIL-101(Cr) while still enabling effective regeneration. With regeneration completed in the desorbing bed, the system 100 subsequently alternates the beds (7*a*, 7*b*) so that the regenerated bed enters its adsorption phase while the companion bed undergoes desorption.

Continuing to refer to FIG. 1, during adsorption phases, in which refrigerant vapor is taken up by the adsorbent material, cooling water from a storage tank 14 is supplied to a selected adsorption bed through one-way valves (6, 12), and warmed water returns to the tank 14 from the adsorption beds (7*a*, 7*b*) through valve (13). Water in tank 14 functions as a heat-removal medium for the adsorption process and is periodically refreshed when its temperature rises above an effective level. Tank 14 serves as a cooling-water reservoir for heat removal from the adsorption beds (7*a*, 7*b*). Although the returning water is warmed during adsorption, the tank 14 is periodically cooled, for example by nighttime ambient conditions, to maintain its effectiveness.

Refrigerant from the atmospheric moisture harvester 2 is routed to the evaporator 20, where the liquid moisture is vaporized by absorbing heat from the water flowing through the evaporator. The evaporator receives water inflow from water storage tank 22 through valve 21 and delivers chilled-water outflowing to a cooling load 17 through valve 18. The cooling load 17 may be, for example, a post-harvest storage room in which chilled water enters an air-handling unit to remove heat from stored agricultural goods. Water warmed by the cooling load 17 returns through valve 19 to water storage tank 22. Similar to the cooling-water tank 14, the water stored in tank 22 may be passively recooled during nighttime ambient conditions to restore its effectiveness for subsequent cooling cycles.

Vaporized refrigerant from the evaporator 20 is supplied to the active adsorption bed (either 7*a* or 7*b*) via one-way valves (15, 16), enabling continuous cycling of the two beds between adsorption and desorption phases. The one-way valve architecture of system 100 coordinates the direction of air, vapor, and water flows so that each bed (7*a*, 7*b*) alternately receives solar-heated air for regeneration and refrigerant vapor for adsorption, while simultaneously allowing independent circulation of cooling water and chilled water. In this manner, the system 100 permits solar-driven regeneration of the adsorbent, continuous production of chilled water, and stable refrigeration performance powered primarily by ambient air and solar heat.

For clarity of operation, Table 1 below summarizes the valve positions corresponding to adsorption and desorption phases for each of the two adsorption beds. The table identifies, for each subsystem, which valves are opened and which are closed depending on whether a given bed is undergoing adsorption or desorption. This arrangement ensures proper routing of solar-heated air, refrigerant vapor, cooling water for the adsorption beds, and chilled water for the cooling load, thereby enabling coordinated switching between beds and continuous refrigeration performance.

TABLE 1

Valve Positions During Adsorption and Desorption Phases

| Design Component | Bed 1 | Bed 2 | Valves open | Valves closed |
|---|---|---|---|---|
| Solar air heater (3) | Adsorption | Desorption | 4 | 5 |
| | Desorption | Adsorption | 5 | 4 |

TABLE 1-continued

Valve Positions During Adsorption and Desorption Phases

| Design Component | Bed 1 | Bed 2 | Valves open | Valves closed |
|---|---|---|---|---|
| Cooling water tank (14) | Adsorption | Desorption | 12, 13 | 6 |
| | Desorption | Adsorption | 6, 13 | 12 |
| Chilled water tank (22) | Adsorption | Desorption | 18, 19, 21 | None |
| | Desorption | Adsorption | 18, 19, 21 | None |
| Atmospheric moisture harvester (2) | Adsorption | Desorption | 11 | 10 |
| | Desorption | Adsorption | 10 | 11 |
| Evaporator (20) | Adsorption | Desorption | 15 | 16 |
| | Desorption | Adsorption | 16 | 15 |

In practical implementations, circulation of cooling water and chilled water within the system 100 may be achieved using a combination of pumps, such as solar powered pumps, and/or gravity feed from the water tanks. The combination of pumps and gravity feed ensures that elevation differences between the adsorbent beds do not materially affect circulation performance. During daytime operation, incident solar energy may directly power DC inverter pumps (not shown) while simultaneously charging a solar battery bank (not shown). During nighttime operation, the battery bank may supply the necessary power to maintain continuous water circulation. Valve actuation likewise requires only low-voltage sinusoidal control signals (e.g., 24 V AC or 0-10 V DC), which can be provided either from a solar battery system or from a low-voltage DC source, enabling reliable switching of flow paths during alternating adsorption and desorption phases.

Figure 2:
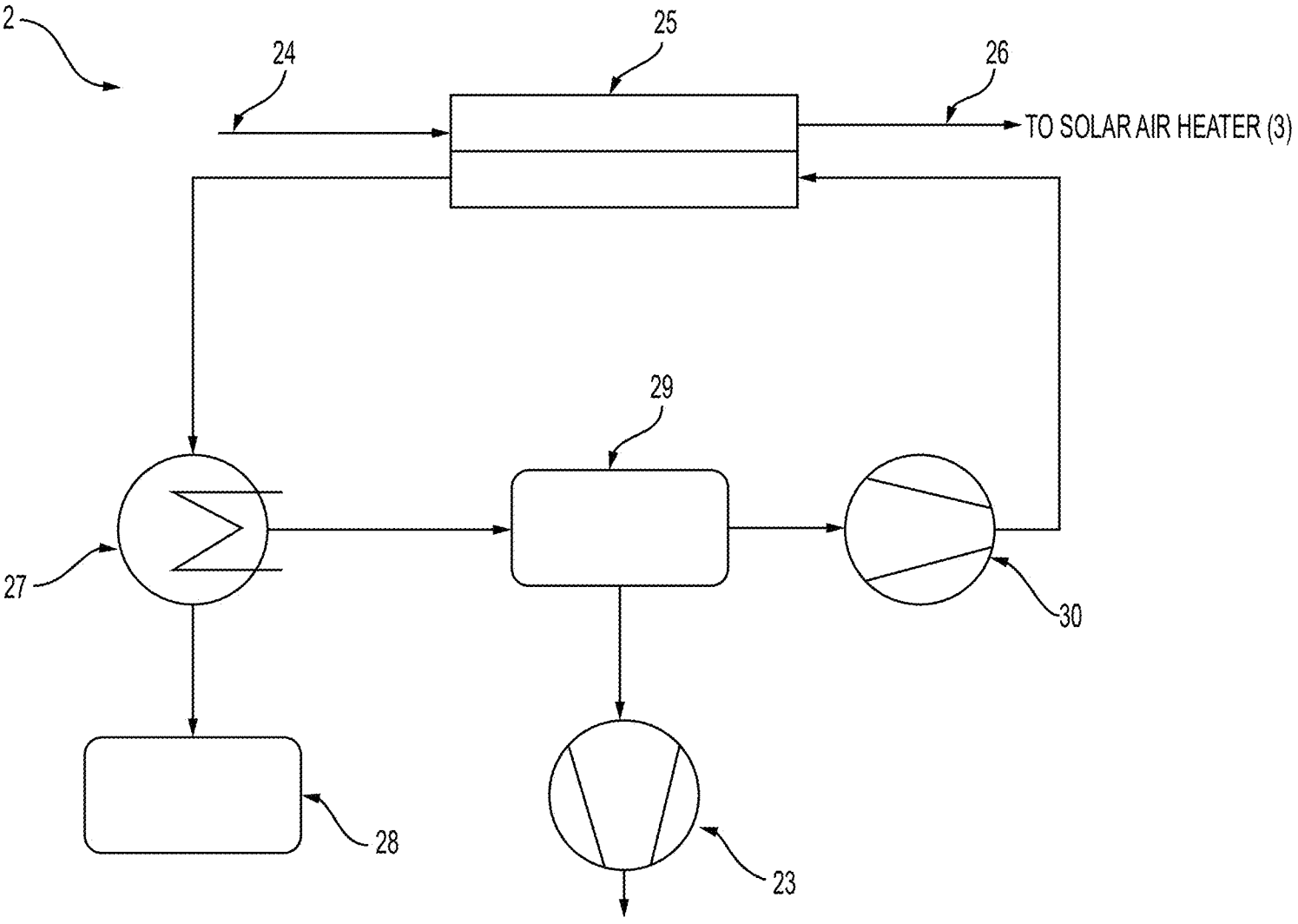
FIG. 2 is a schematic diagram of an atmospheric water harvesting subsystem used in the system of FIG. 1.

Turning to FIG. 2, the atmospheric moisture harvester 2 utilized in the coupled adsorption refrigeration cycle of FIG. 1 is shown in greater detail. In operation, moist ambient air is drawn in through an inlet duct 24 under the suction generated by a vacuum pump 23. The vacuum pump 23 induces atmospheric air to flow naturally into inlet 24 without requiring mechanical compression at the intake. The incoming moist ambient air is first directed through a moisture-selective membrane 25, which functions to remove humidity from the air by selectively permitting the passage of water vapor while retaining the bulk air components. In such membranes, water vapor preferentially dissolves into and diffuses through the material due to its strong polarity with the material, whereas the bulk air components do not permeate the membrane. As a result, the membrane selectively transports moisture while retaining the remaining air stream.

Water vapor extracted by the membrane 25 is directed to a condenser 27, where it is condensed using ambient-air cooling or a secondary coolant. The condenser removes moisture originating both from the incoming ambient air and from refrigerant vapor returned from the adsorption beds during desorption. The resulting liquid is collected in a storage tank 28, which supplies the evaporator 20 (see FIG. 1) of the adsorption refrigeration system 100 with refrigerant (i.e., the harvested atmospheric moisture) by gravity or auxiliary pumping.

Air that retains residual moisture after the membrane stage enters a reserve tank 29, which serves as a buffer volume and additional moisture-recovery chamber. A recirculating pump 30 withdraws this partially dried air from the reserve tank 29 and returns it to the membrane for repeated passes, improving moisture-harvesting efficiency and minimizing refrigerant loss.

Figure 3:
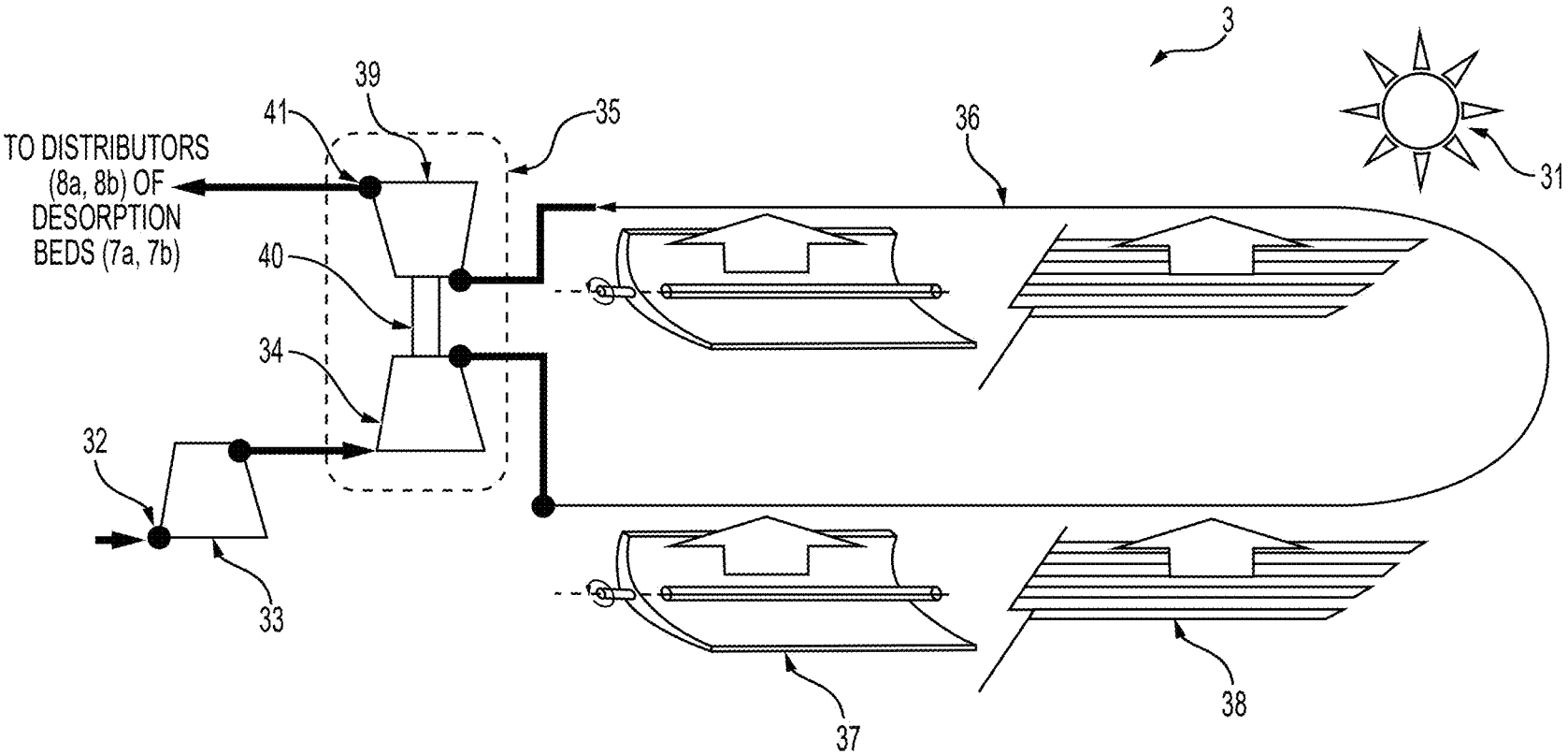
FIG. 3 is a schematic diagram of a solar air-heating subsystem used in the system of FIG. 1.

FIG. 3 illustrates an embodiment of the solar air-heating system 3 of FIG. 1 employed to generate the high-temperature dried air used for regenerating the adsorption beds (7*a*, 7*b*) of the adsorption refrigeration system. Partially dried air from the outlet 26 of the atmospheric moisture harvester 2 (of FIG. 2) enters the solar air-heater 3 through an inlet 32. A preliminary compressor 33 performs a first stage of air compression, raising the pressure and temperature of the incoming air. Downstream of the preliminary compressor 33, a secondary compressor 34 provides further compression. The secondary compressor 34 is enclosed within a turbocharger housing 35, which allows for mechanical coupling to a later-stage reaction turbine 39. Air discharged from the secondary compressor 34 enters a receiver tube 36, where it is exposed to concentrated solar radiation 31. Solar radiation 31 is concentrated onto the receiver tube 36 using two types of solar collectors: a parabolic trough collectors 37, and Fresnel linear collectors 38.

The parabolic trough collectors 37 employ a curved, parabolic reflector to focus incident sunlight onto a linear focal line where the receiver tube 36 is positioned, thereby achieving high solar concentration along its length. In contrast, the Fresnel linear collectors 38 use an array of flat or slightly curved mirror segments arranged in a stepped configuration to approximate a parabolic shape, redirecting sunlight onto the same receiver tube with a more compact and cost-efficient optical structure. Using both the parabolic trough collectors 37 and Fresnel linear collectors 38 allows the system to combine the high optical efficiency of parabolic troughs with the lower cost, compact footprint, and broader angular tolerance of Fresnel collectors. Together, the two collector types provide enhanced solar flux, improved temperature stability, and cost-effective scalability of the solar air-heating subsystem.

The parabolic trough collectors 37 and Fresnel linear collectors 38 are positioned along both sides of the receiver tube 36 and focus solar radiation 31 through a transparent outer external casing towards an inner absorber tube within receiver tube 36 (discussed more below with reference to FIG. 4). The concentrated solar radiation 31 substantially increases the temperature of the compressed air flowing through the receiver tube 36, elevating it to temperatures of at least 300° C., and more particularly between 400-500° C. This solar-enhanced heating step generates the high-temperature dry air required to promote rapid desorption within the adsorption beds (7*a*, 7*b*) of FIG. 1.

Following solar heating, the high-temperature compressed air enters a reaction turbine 39. Within reaction turbine 39, the heated air undergoes controlled expansion, which reduces its pressure back toward ambient levels while harvesting mechanical power from the expanding flow. Much of the expansion energy is transferred through a compressor shaft 40 that mechanically drives the secondary compressor 34, enabling the compressor to operate with little or no net external power input. The arrangement allows the secondary compressor 34 to be powered using the energy recovered during expansion, with negligible head loss, enabling a self-sustaining turbo-compressor-turbine cycle powered principally by solar heat.

Once expanded in the reaction turbine 39, the air stream remains at a high temperature but is reduced to approximately atmospheric pressure. The depressurized, solar-heated dried air is discharged from the air-heating system at a release point 41. From this release point 41, the heated air is directed toward the distributors (8*a*, 8*b*) located at the inlet of the desorption beds (7*a*, 7*b*), where the heated air spreads uniformly across the packed adsorbent material within the beds, heating the adsorbent and driving desorption of the previously adsorbed moisture, as described above with respect to FIG. 1.

Figure 4:
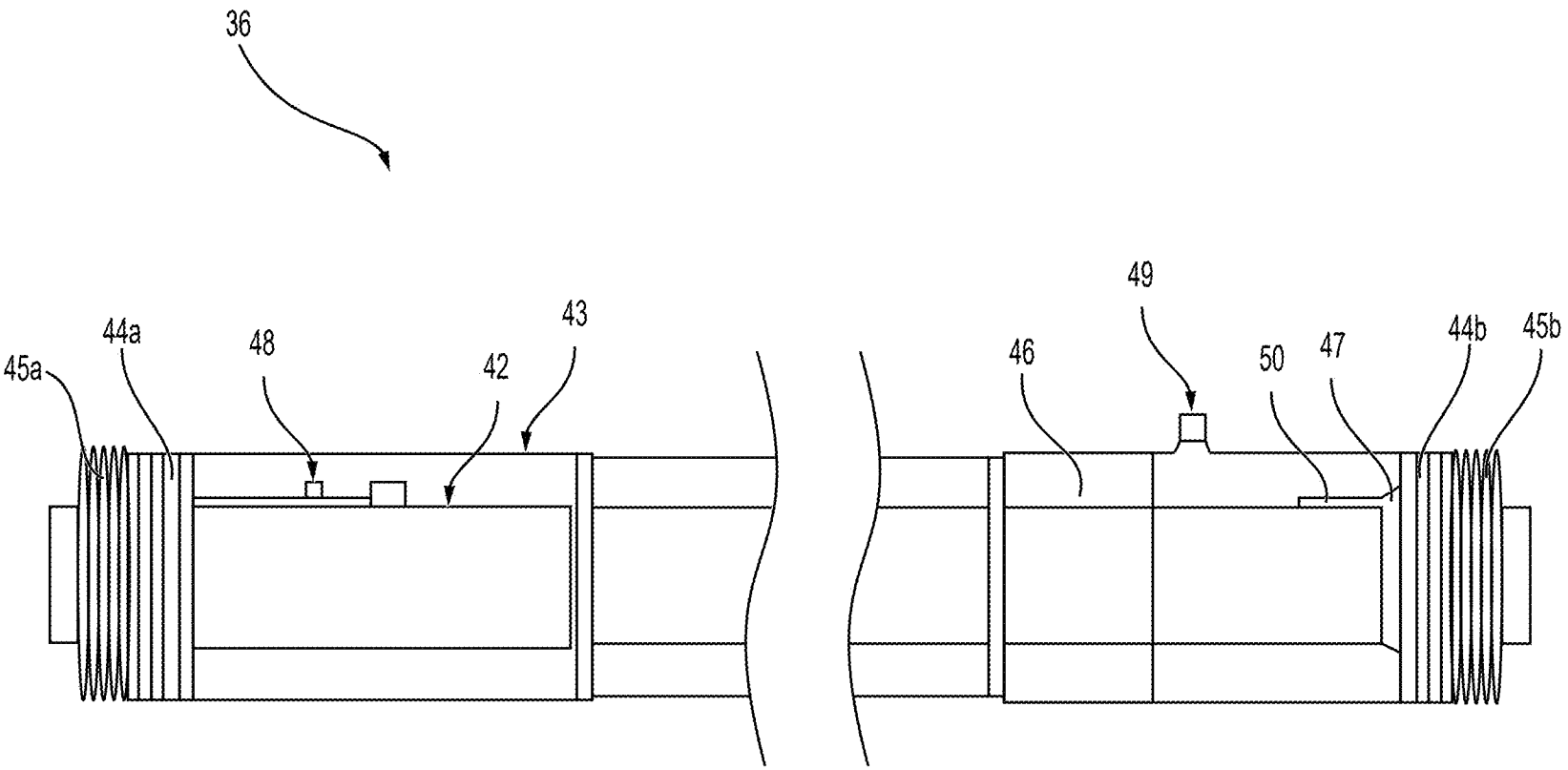
FIG. 4 is a solar receiver tube assembly used in the solar air-heating subsystem of FIG. 3.

Turning to FIG. 4, a closer view of the receiver tube 36 employed in the solar air-heater 3 is shown. The receiver tube 36 functions as the primary thermal absorption and air-heating conduit within the solar air-heater 3. As shown, the receiver tube 36 includes an absorber tube 42, which is typically constructed of stainless steel or another high-temperature-resistant material capable of efficiently absorbing incident solar radiation. Surrounding at least a portion of the absorber tube 42 is a glass envelope 43, which may be coated with an antireflective layer to enhance transmission of solar radiation. The arrangement allows sunlight concentrated by the parabolic trough collectors 37 and Fresnel linear collectors 38 to pass through glass envelope 43 and impinge upon the absorber tube 42, raising the temperature of the air flowing within it.

Each end of the receiver tube 36 includes sealing structures designed to maintain both structural integrity and thermal efficiency. Air-tight seals (44*a*, 44*b*) are positioned to prevent leakage of air into or out of the annular region surrounding between the absorber tube 42 and glass envelope 43. The seals (44*a*, 44*b*) also cooperate with thermal expansion compensators (45*a*, 45*b*) that accommodate dimensional changes caused by repeated heating and cooling cycles, thereby reducing mechanical stress on the absorber tube 42 and maintaining the alignment of internal components.

Between the absorber tube 42 and the surrounding glass envelope 43 lies a vacuum annulus 46. Vacuum annulus 46 serves to minimize conductive and convective thermal losses from the heated air within the absorber tube 42 to the external environment. Maintaining a vacuum is important for both thermal efficiency and system durability. As illustrated, non-volatile getter pills 47 and a barium getter 48 are positioned within or adjacent to the vacuum annulus 46 to absorb stray gas molecules that may migrate into the evacuated region over time. These getters help sustain the vacuum level during prolonged operation and preserve the insulating characteristics of the vacuum annulus 46.

A pump valve 49 is provided on the glass envelope 43 to regulate the volumetric flow rate or internal pressure of the heated air within the absorber tube 42. Pump valve 49 may be used for system calibration, operational control, or maintenance, and permits fine tuning of airflow through the receiver tube 36 as solar heating conditions vary. A serial number or identification marking 50 is also shown, which may be used to track the manufacturing history, warranty, and quality control status of the receiver tube 36.

Overall, the configuration depicted in FIG. 4 provides a durable, thermally efficient, and mechanically stable receiver tube capable of sustaining repeated high-temperature operation. Through the combination of vacuum insulation, radiation-transparent glass, structural compensation features, and active getters, the assembly supports efficient transfer of concentrated solar energy into the air stream used for regenerating the adsorption beds.

Figure 5:
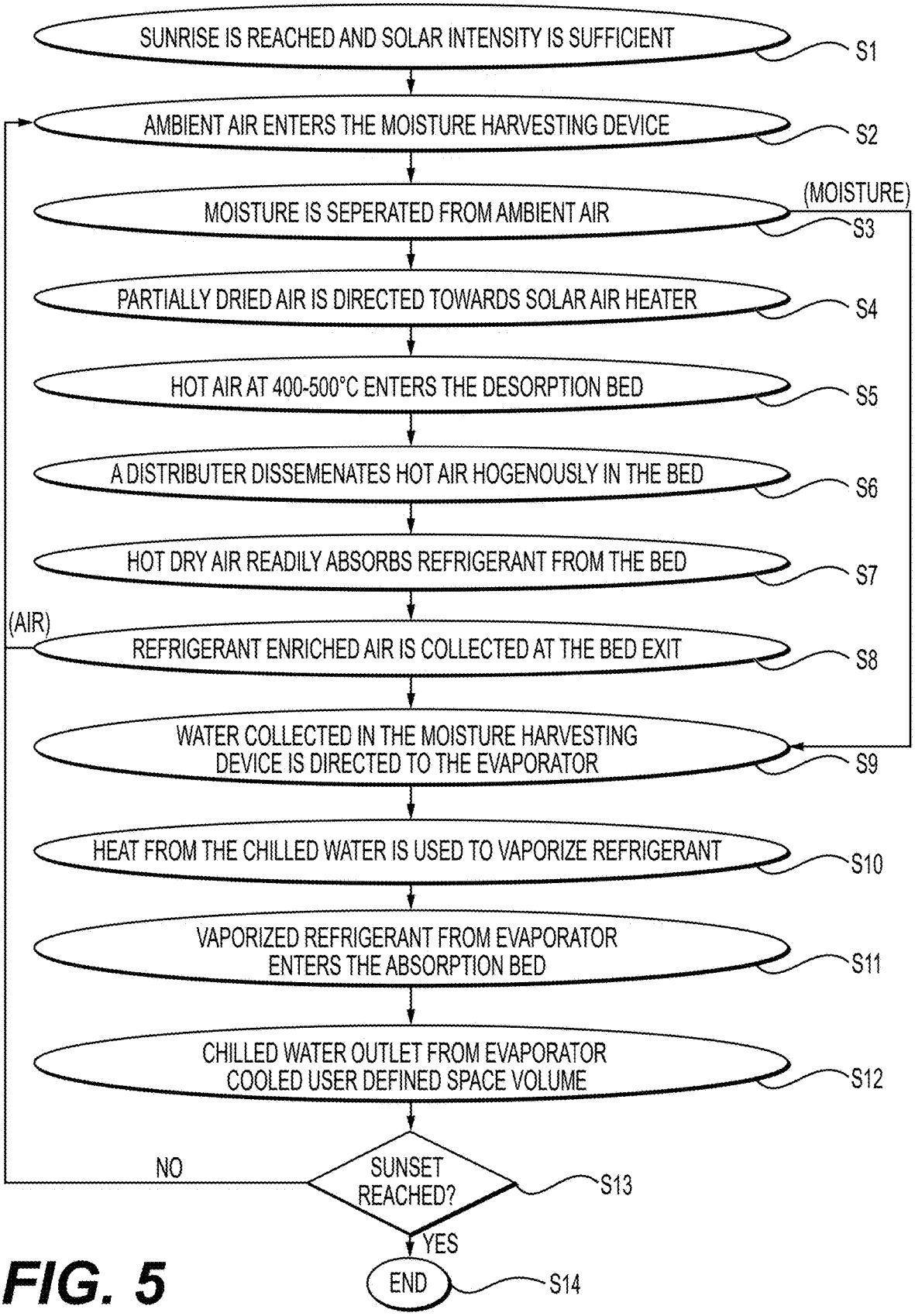
FIG. 5 is a flow chart illustrating an exemplary method of operation of the system of FIG. 1.

Turning to FIG. 5, a process flowchart is illustrated representing an exemplary operational sequence of the disclosed adsorption refrigeration system. The sequence begins at step S1, where sunrise is reached and solar radiation becomes sufficient to enable effective air heating within the solar air-heater 3. Once adequate solar intensity is available, the system commences active operation.

At step S2, ambient air is drawn into the atmospheric moisture harvester 2. The ambient air passes across the moisture-selective membrane 25, which separates water vapor from the air stream. Step S3 represents this moisture-separation process, resulting in a partially dried air stream containing significantly reduced humidity. At step S4, the partially dried air is directed toward the solar air heater 3 for thermal processing.

Within the solar air-heating subsystem of FIGS. 3-4, the dried air is subjected to concentrated solar radiation and heating, ultimately reaching temperatures of at least 300° C., and more particularly in the range of about 400-500° C. At step S6, this high-temperature dry air enters a desorption bed (7*a* or 7*b*). Prior to full entry into the packed bed, the air encounters an air distributor (8*a* or 8*b*), depicted at step S5, which disseminates the hot air uniformly across the adsorbent bed (7*a* or 7*b*) to ensure homogeneous thermal exposure.

Once introduced into the bed, the hot dry air promotes desorption of the refrigerant from the adsorbent material. Step S7 captures this phase, during which the heated air readily absorbs the moisture originally held within the pores of the adsorbent by virtue of simultaneous temperature-gradient and concentration-gradient driving forces. At step S8, the moisture-enriched air exiting the bed is collected and returned to the atmospheric moisture harvester 2 for condensation and liquid recovery.

In step S9, liquid moisture accumulated in the atmospheric moisture harvester 2 is directed toward the evaporator 20. Within evaporator 20, heat extracted from the chilled-water circuit, between evaporator 20 and cooling load 17, is transferred to the liquid moisture received from the atmospheric moisture harvester. Step S10 illustrates this heat-exchange process, during which the chilled water supplies sufficient energy to vaporize the refrigerant, owing to low-pressure conditions inside the evaporator 20. The vaporized refrigerant is then conveyed to an adsorption bed (7*a* or 7*b*), as indicated at step S11, where it is adsorbed by the particular bed that is in the adsorption phase.

Concurrently, step S12 represents the function of the chilled-water circuit exiting the evaporator 20. After transferring heat to the refrigerant, the water becomes further chilled and is used to cool the cooling load 17. The process continues until the system detects that sunset has been reached, represented at step S13. If solar radiation is no longer adequate to sustain high-temperature heating of the dried air, the operational cycle concludes at step S14. During daylight operation, the sequence of steps is repeated continuously, with alternating adsorption and desorption cycles between two adsorbent beds to maintain ongoing cooling performance throughout the solar window.

The foregoing description illustrates how the atmospheric water-harvesting unit, solar air-heating unit, and adsorption refrigeration unit operate cooperatively to form a coupled thermodynamic cycle. By coordinating refrigerant generation, air heating, adsorbent regeneration, and chilled-water production, the system maintains continuous cooling throughout periods of adequate solar irradiance. The described flow sequences, component interactions, and valve operations represent exemplary implementations suitable for achieving sustained solar-driven refrigeration performance.

It is to be understood that the adsorption refrigeration system with atmospheric water harvesting and solar heating is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

The invention claimed is:

1. An adsorption refrigeration system comprising:

A an atmospheric moisture harvester configured to remove vapor moisture from ambient air to produce dried air and liquid moisture;

a solar air-heating unit configured to heat the dried air to form heated dried air;

at least one adsorbent bed containing an adsorbent material configured to receive the heated dried air directly into contact with the adsorbent material to desorb the adsorbent material; and an evaporator configured to receive at least a portion of the liquid moisture as a refrigerant, to vaporize the refrigerant, and to supply vaporized refrigerant to the adsorbent bed during an adsorption phase.

2. The system of claim 1, wherein the atmospheric moisture harvester comprises a moisture-selective membrane configured to remove the vapor moisture from the ambient air.

3. The system of claim 2, wherein the atmospheric moisture harvester further comprises a recirculation path configured to return residual-moisture air to the moisture-selective membrane.

4. The system of claim 1, wherein the atmospheric moisture harvester comprises a vacuum pump configured to generate reduced pressure within the atmospheric moisture harvester and draw the ambient air into the atmospheric moisture harvester.

5. The system of claim 1, wherein the atmospheric moisture harvester further comprises a condenser configured to condense moisture separated from the ambient air.

6. The system of claim 1, wherein the system includes a storage tank configured to collect the condensed moisture.

7. The system of claim 1, wherein the solar air-heating unit comprises a solar receiver tube configured to expose the dried air flowing therein to concentrated solar radiation.

8. The system of claim 7, wherein the solar air-heating unit comprises at least one solar collector selected from the group consisting of: a parabolic trough collector, a Fresnel collector, and combinations thereof.

9. The system of claim 1, wherein the solar air-heating unit comprises a compressor configured to compress the dried air prior to solar heating.

10. The system of claim 9, further comprising a turbine configured to expand solar-heated air and drive the compressor.

11. The system of claim 1, wherein the solar air-heating unit is configured to heat the dried air to a temperature of at least 300° C.

12. The system of claim 1, wherein the at least one adsorbent bed comprises two adsorbent beds configured for alternating adsorption and desorption therebetween.

13. The system of claim 1, wherein the at least one adsorbent bed comprises an air distributor configured to distribute heated air homogeneously into the at least one adsorbent bed.

14. The system of claim 1, wherein air exiting the at least one adsorbent bed is directed to the atmospheric moisture harvester for removal of desorbed moisture.

15. The system of claim 1, wherein the adsorbent material comprises a metal-organic framework.

16. The system of claim 1, further comprising valves configured to regulate flows of dried air, heated air, refrigerant vapor, and cooling water.

17. A method of operating an adsorption refrigeration system, comprising:

introducing ambient air into an atmospheric moisture harvester;

separating moisture from the ambient air to produce dried air and liquid moisture;

heating the dried air using solar energy to form heated dried air;

directing the heated dried air into direct contact with an adsorbent material in an adsorbent bed to regenerate the adsorbent material;

directing at least a portion of the liquid moisture to an evaporator; and directing vaporized refrigerant from the evaporator to the adsorbent bed during an adsorption phase.

18. The method of claim 17, wherein separating moisture comprises passing ambient air across a moisture-selective membrane.

19. The method of claim 17, wherein heating the dried air comprises directing the dried air through a solar-heated receiver tube.

20. An adsorption refrigeration system comprising:

an atmospheric moisture harvester including a moisture-selective membrane and a condenser configured to separate and liquefy moisture from ambient air;

a solar air-heating unit comprising a solar receiver tube configured to heat dried air to a temperature of at least 300° C. to form heated dried air; and an adsorption refrigeration unit comprising two adsorbent beds configured for alternating adsorption and desorption phases using the heated dried air and a refrigerant derived from the liquefied moisture.

* * * * *